US009565957B2

(12) United States Patent
McDonough et al.

(10) Patent No.: US 9,565,957 B2
(45) Date of Patent: Feb. 14, 2017

(54) DEVICE FOR HOLDING A BEVERAGE CONTAINER AND PLATE

(71) Applicant: BlueRed Ventures, LLC, Waxhaw, NC (US)

(72) Inventors: William McDonough, Waxhaw, NC (US); Dean Tener, Charlotte, NC (US)

(73) Assignee: BlueRed Ventures, LLC, Waxhaw, NC (US)

( * ) Notice: Subject to any disclaimer, the term of this patent is extended or adjusted under 35 U.S.C. 154(b) by 0 days.

(21) Appl. No.: 14/516,185

(22) Filed: Oct. 16, 2014

(65) Prior Publication Data

US 2015/0313385 A1 Nov. 5, 2015

Related U.S. Application Data

(60) Provisional application No. 61/988,466, filed on May 5, 2014.

(51) Int. Cl.

| | |
|---|---|
| ***B65D 3/28*** | (2006.01) |
| ***A47G 19/08*** | (2006.01) |
| ***A47G 23/02*** | (2006.01) |

(52) U.S. Cl.
CPC ..... *A47G 19/08* (2013.01); *A47G 23/02* (2013.01); *A47G 23/0225* (2013.01)

(58) Field of Classification Search
CPC ... A47G 19/065; A47G 23/0225; A47G 23/02
USPC ..... 220/737
See application file for complete search history.

(56) References Cited

U.S. PATENT DOCUMENTS

| | | | | |
|---|---|---|---|---|
| 4,961,555 | A * | 10/1990 | Egan, Jr. | A47G 23/0225 211/41.2 |
| 5,110,170 | A * | 5/1992 | Boatwright | A47G 19/06 206/562 |
| 6,682,034 | B1 * | 1/2004 | Vial | A47G 19/04 248/231.81 |
| 8,573,437 | B1 * | 11/2013 | Evans | A47J 45/00 206/562 |
| 8,985,379 | B1 * | 3/2015 | Evans | A47J 45/00 206/562 |

* cited by examiner

*Primary Examiner* — Shawn M Braden
(74) *Attorney, Agent, or Firm* — Perkins Coie LLP

(57) ABSTRACT

The present disclosure relates to the field of devices for holding, conjoining and/or securing a cup and plate.

4 Claims, 9 Drawing Sheets

DEVICE FOR HOLDING A BEVERAGE CONTAINER AND PLATE

PRIORITY CLAIM

This application claims priority to U.S. provisional patent application Ser. No. 61/988,466, filed on May 5, 2014, the entire contents of which are incorporated herein by reference and relied upon.

TECHNICAL FIELD

The present disclosure relates to the field of devices for holding, conjoining and/or securing a cup and plate.

BACKGROUND

Food and beverages are the common denominator for events to meet with family, socialize with friends, converse in business discussions, and whenever people gather together. The events are commonly parties, picnics, tailgates or catered affairs where seating at tables is limited or not available at all, and attendees are expected to carry their food and beverages as they circulate.

It is very difficult to hold or balance both the plate and beverage container while attempting to eat from the plate or when trying to shake hands while greeting other guests. As such, people will frequently attempt to shuffle the plate and beverage container into one hand, or move to find a location to place the beverage container while they either eat from the plate or greet another person. As a consequence, food, drink or both are typically spilled or misplaced. This leads to mess, waste and diminishes the overall experience for the guest. A need exists for improved low-cost devices for holding a cup and a plate.

SUMMARY

The present disclosure provides a device for holding a plate and a second object such as a cup, a can, a bottle and/or stemware. In some embodiments, the device employs cantilever action to balance weight of the plate (including food) and the second object (including any contents therein). In some embodiments, the device allows a user to easily hold the device with one hand.

In one embodiment, the present disclosure provides a device comprising a ring or a portion thereof; a support arm connected to the ring or portion thereof at a first circumferential point; and a grasping arm connected to the ring or portion thereof in close proximity to the first circumferential point. The ring or portion thereof is sized for supporting a cup, while the support arm and the grasping arm are configured to support and/or secure a plate.

In another embodiment, the present disclosure provides a cup holder comprising a support arm extending from the cup holder including a substantially flat portion defining a first length L1; and a grasping arm extending from the cup holder substantially parallel to the support arm and defining a second length L2, wherein first length L1 is greater than second length L2. The support arm and grasping arm are configured to support and/or secure a plate.

DETAILED DESCRIPTION

While the present invention is capable of being embodied in various forms, the description below of several embodiments is made with the understanding that the present disclosure is to be considered as an exemplification of the invention, and is not intended to limit the invention to the specific embodiments illustrated. Headings are provided for convenience only and are not to be construed to limit the invention in any manner. Embodiments illustrated under any heading may be combined with embodiments illustrated under any other heading.

The use of numerical values in the various quantitative values specified in this application, unless expressly indicated otherwise, are stated as approximations as though the minimum and maximum values within the stated ranges were both preceded by the word "about." Also, the disclosure of ranges is intended as a continuous range including every value between the minimum and maximum values recited as well as any ranges that can be formed by such values. Also disclosed herein are any and all ratios (and ranges of any such ratios) that can be formed by dividing a disclosed numeric value into any other disclosed numeric value. Accordingly, the skilled person will appreciate that many such ratios, ranges, and ranges of ratios can be unambiguously derived from the numerical values presented herein and in all instances such ratios, ranges, and ranges of ratios represent various embodiments of the present invention.

Figure 1:
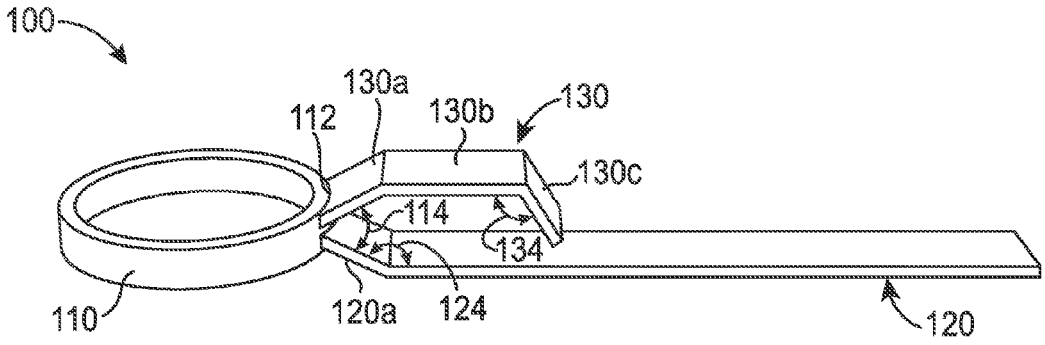
FIG. 1 shows a perspective view of one embodiment of the present disclosure designed to accommodate narrow or taper plates.

As shown in FIG. 1, device 100 comprises a ring 110, a support arm 120 and a grasping arm 130. Support arm 120 includes a first support arm section 120*a* and a second support arm section 120*b*, which together define angle 124. Grasping arm 130 includes first grasping arm section 130*a*, second grasping arm section 130*b* and terminal grasping arm section 130*c*. First grasping arm section 130*a* and first support arm section 120*a* each extend from ring 110 at substantially the same circumferential point 112, and are separated from each other by an angle 114. Second grasping arm section 130*b* and terminal grasping arm section 130*c* define angle 134 such that terminal grasping arm section 130*c* extends toward support arm 120. In operation, a beverage container is seated inside ring or portion thereof 110 and a plate is secured using support arm 120 and grasping arm 130. For example, a lip of a plate is slid into the aperture between support arm 120 and grasping arm 130. Terminal grasping arm section 130*c* prevents the plate from sliding by securing the lip of the plate (e.g., by forming a barrier to prevent the plate from sliding along the length of the support arm 120 and/or by applying pressure on the plate towards support arm 120. In some embodiments, grasping arm 130*c* is flexible, for example to allow temporary expansion of an aperture between the grasping arm 130 and the support arm 120. In some embodiments, at least a portion of grasping arm 130 is flexible. In some embodiments, first grasping arm section 130*a* is flexible. In some embodiments, second grasping arm section 130*b* is flexible. In some embodiments, terminal grasping arm section 130*c* is flexible. Flexibility properties of the grasping arm 130 or any portion thereof can be accomplished by any suitable means including, for example, forming the grasping arm 130 or any portion thereof of a material comprising a flexible component such as rubber, plastic, etc. In some embodiments, at least a portion of support arm 120 includes a surface texture to increase a coefficient of friction between the support arm 120 and the plate.

Figure 2:
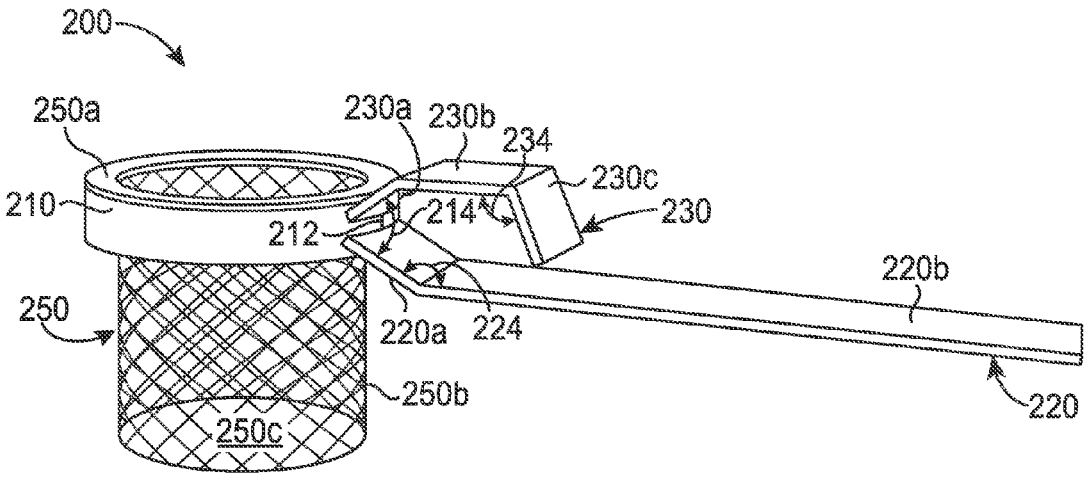
FIG. 2 shows a perspective view of an embodiment similar to that of FIG. 1 additionally including a beverage can adapter.

FIG. 2 illustrates a second embodiment of the present disclosure in which device 200 is configured to support a beverage container having substantially straight sides, a narrower top section than bottom section, or requires additional support. In this embodiment, adapter 250 includes a flange portion 250*a* that is configured to mate with, seat in, and/or rest on/over ring or portion thereof 210; side wall(s) 250*b* attached to flange portion 250*a*, and a base 250*c* attached to the side wall(s) 250*b*. In some embodiments, base 250*c* includes a concentric bottom with a variety of depths configured to stabilize beverage containers having a narrower diameter than the inner diameter of the flange portion 250*a*. In some embodiments adapter 250 is removably inserted into ring or portion thereof 210. In some embodiments, adapter 250 is attached to or adhered to ring or portion thereof 210. In some embodiments, adapter 250 is temporarily or permanently secured to ring or portion thereof 210. Support arm 220 includes a first support arm section 220*a* and a second support arm section 220*b*, which together define angle 224. Grasping arm 230 includes first grasping arm section 230*a*, second grasping arm section 230*b* and terminal grasping arm section 230*c*. First grasping arm section 230*a* and first support arm section 220*a* each extend from ring 210 at substantially the same circumferential point 212, and are separated from each other by an angle 214. Second grasping arm section 230*b* and terminal grasping arm section 230*c* define angle 234 such that terminal grasping arm section 230*c* extends toward support arm 220. In operation, a beverage container is seated inside ring or portion thereof 210 and a plate is secured using support arm 220 and grasping arm 230. For example, a lip of a plate is slid into the aperture between support arm 220 and grasping arm 230. Terminal grasping arm section 230*c* prevents the plate from sliding by securing the lip of the plate (e.g., by forming a barrier to prevent the plate from sliding along the length of the support arm 220 and/or by applying pressure on the plate towards support arm 220. In some embodiments, grasping arm 230*c* is flexible, for example to allow temporary expansion of an aperture between the grasping arm 230 and the support arm 220. In some embodiments, at least a portion of grasping arm 230 is flexible. In some embodiments, first grasping arm section 230*a* is flexible. In some embodiments, second grasping arm section 230*b* is flexible. In some embodiments, terminal grasping arm section 230*c* is flexible. Flexibility properties of the grasping arm 230 or any portion thereof can be accomplished by any suitable means including, for example, forming the grasping arm 230 or any portion thereof of a material comprising a flexible component such as rubber, plastic, etc. In some embodiments, at least a portion of support arm 220 includes a surface texture to increase a coefficient of friction between the support arm 220 and the plate.

Figure 3:
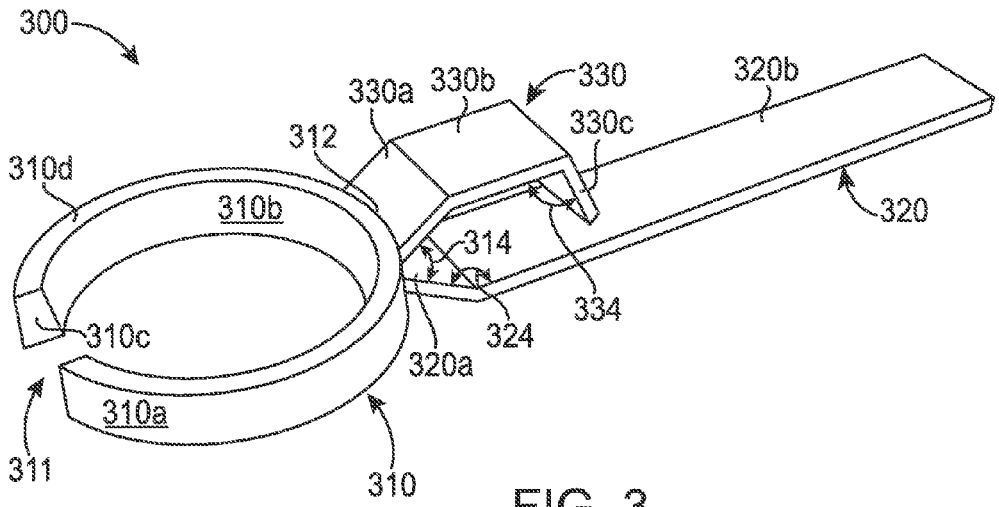
FIG. 3 shows a perspective view of an embodiment similar to that of FIG. 1 additionally including a stemware holder.

As shown in FIG. 3, another embodiment of the present disclosure provides a device 300 including a cup holder portion 310 comprising a discontinuous ring (e.g., a portion of a ring) defining a aperture 311. In one embodiment, the aperture 311 is located opposite or substantially opposite a circumferential point 312 where at least one of a support arm 320 and a grasping arm 330 are connected to the cup holder portion 310. In one embodiment, the support arm 320 and the grasping arm 330 are both connected to the cup holder portion 310 at circumferential point 312. In one embodiment, the cup holder portion 310 includes an outer surface 310*a* and an inner surface 310*b* that are not parallel. In the embodiment shown in FIG. 3, for example, the cup holder portion 310 has an outer surface 310*a* and an inner surface 310*b* that are not parallel, and are configured to provide a top edge 310*d* that is narrower than a bottom edge 310*e*. Cup holder portion 310 thus has a cross-sectional shape 310*c* that is a quadrilateral or trapezoidal. In some embodiments, the cross-sectional shape 310*c* is a regular quadrilateral, such as a regular trapezoid. Support arm 320 includes a first support arm section 320*a* and a second support arm section 320*b*, which together define angle 324. Grasping arm 330 includes first grasping arm section 330*a*, second grasping arm section 330*b* and terminal grasping arm section 330*c*. First grasping arm section 330*a* and first support arm section 320*a* each extend from ring 310 at substantially the same circumferential point 312, and are separated from each other by an angle 314. Second grasping arm section 330*b* and terminal grasping arm section 330*c* define angle 334 such that terminal grasping arm section 330*c* extends toward support arm 320. In operation, a beverage container is seated inside ring or portion thereof 310 and a plate is secured using support arm 320 and grasping arm 330. For example, a lip of a plate is slid into the aperture between support arm 320 and grasping arm 330. Terminal grasping arm section 330*c* prevents the plate from sliding by securing the lip of the plate (e.g., by forming a barrier to prevent the plate from sliding along the length of the support arm 320 and/or by applying pressure on the plate towards support arm 320. In some embodiments, grasping arm 330*c* is flexible, for example to allow temporary expansion of an aperture between the grasping arm 330 and the support arm 320. In some embodiments, at least a portion of grasping arm 330 is flexible. In some embodiments, first grasping arm section 330*a* is flexible. In some embodiments, second grasping arm section 330*b* is flexible. In some embodiments, terminal grasping arm section 330*c* is flexible. Flexibility properties of the grasping arm 330 or any portion thereof can be accomplished by any suitable means including, for example, forming the grasping arm 330 or any portion thereof of a material comprising a flexible component such as rubber, plastic, etc. In some embodiments, at least a portion of support arm 320 includes a surface texture to increase a coefficient of friction between the support arm 320 and the plate.

Figure 4:
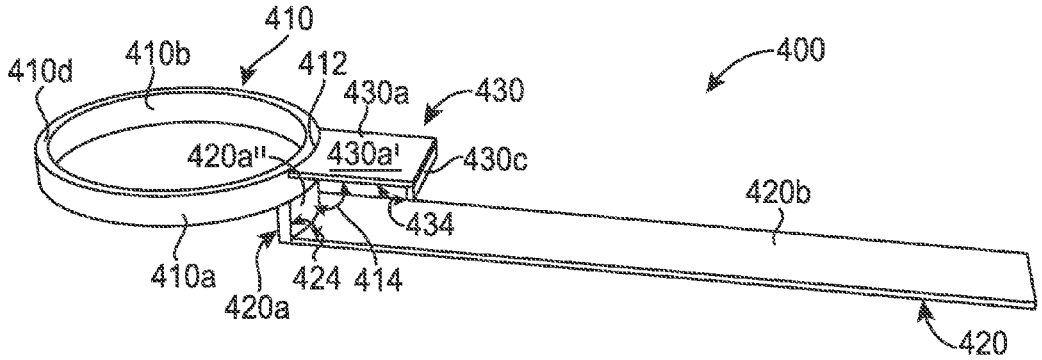
FIG. 4 is a perspective view of another embodiment of the present disclosure configured to accommodate plates with higher or more vertical edges/lips.

As shown in FIG. 4, one embodiment of the present disclosure includes a cup holder portion 410 that is a ring and includes an outer surface 410*a*, an inner surface 410*b*, a top edge 410*d* and a bottom edge 410*e* (not shown). A support arm 420 and a grasping arm 430 are each attached to the cup holder portion 410 at circumferential point 412. Support arm 420 includes a first support arm section 420*a* that extends downwardly from the cup holder portion 410. In some embodiments, first support arm section 420*a* shares a continuous inner surface 420*a*' (not shown) with inner ring surface 410*b*. In some embodiments, first support arm section 420*a* shares a continuous outer surface 420*a*" with outer ring surface 410*a*. A second support arm section 420*b* is connected to first support arm section 420*a* at an angle 424 which in the embodiment shown in FIG. 4 is about 90°. Grasping arm 430 includes a first grasping arm section 430*a* that includes a top surface 430*a*'. In some embodiments, top surface 430*a*' is continuous or substantially continuous with top ring edge 410*d*. First grasping arm section 430*a* and first support arm section 420*a* define angle 414 which, in the embodiment shown in FIG. 4, is about 90°. Grasping arm 430 further includes a terminal grasping arm section 430*c* connected to the first grasping arm section 430*a* and defining angle 434 which, in the embodiment shown in FIG. 4, is about 90°. In operation, a beverage container is seated in cup holder portion 410 and a plate is secured using support arm 420 and grasping arm 430. For example, a lip of a plate is slid into the aperture between support arm 420 and grasping arm 430. Terminal grasping arm section 430*c* prevents the plate from sliding by securing the lip of the plate (e.g., by forming a barrier to prevent the plate from sliding along the length of the support arm 420 and/or by applying pressure on the plate towards support arm 420. In some embodiments, grasping arm 430*c* is flexible, for example to allow temporary expansion of an aperture between the grasping arm 430 and the support arm 420. In some embodiments, at least a portion of grasping arm 430 is flexible. In some embodiments, first grasping arm section 430*a* is flexible. In some embodiments, terminal grasping arm section 430*c* is flexible. Flexibility properties of the grasping arm 430 or any portion thereof can be accomplished by any suitable means including, for example, forming the grasping arm 430 or any portion thereof of a material comprising a flexible component such as rubber, plastic, etc. In some embodiments, at least a portion of support arm 420 includes a surface texture to increase a coefficient of friction between the support arm 420 and the plate.

Figure 5:
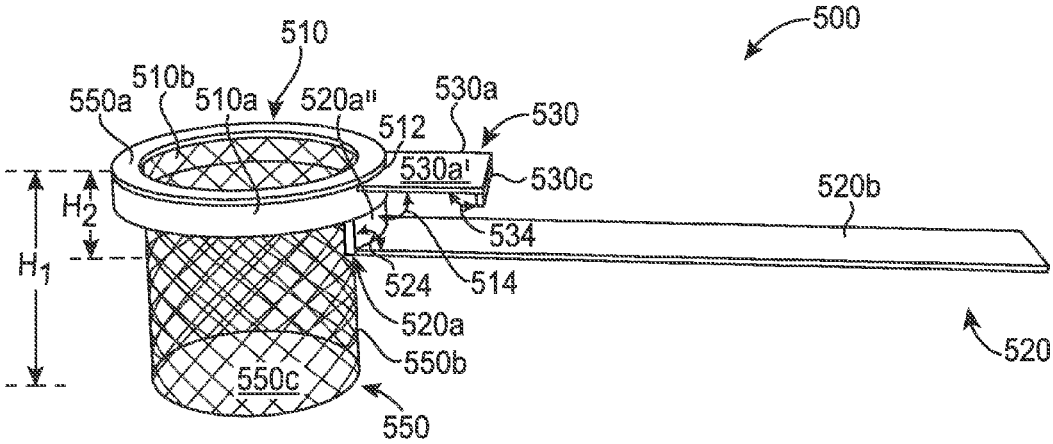
FIG. 5 shows a perspective view of an embodiment similar to that of FIG. 4 additionally including a beverage can adapter.

As shown in FIG. 5, one embodiment of the present disclosure includes a cup holder portion 510 that is a ring and includes an outer surface 510*a*, an inner surface 510*b*, a top edge 510*d* (not shown) and a bottom edge 510*e* (not shown). A support arm 520 and a grasping arm 530 are each attached to the cup holder portion 510 at circumferential point 512. Support arm 520 includes a first support arm section 520*a* that extends downwardly from the cup holder portion 510. In some embodiments, first support arm section 520*a* shares a continuous inner surface 520*a*' (not shown) with inner ring surface 510*b*. In some embodiments, first support arm section 520*a* shares a continuous outer surface 520*a*" with outer ring surface 510*a*. A second support arm section 520*b* is connected to first support arm section 520*a* at an angle 524 which in the embodiment shown in FIG. 5 is about 90°. Grasping arm 530 includes a first grasping arm section 530*a* that includes a top surface 530*a*'. In some embodiments, top surface 530*a*' is continuous or substantially continuous with top ring edge 510*d*. First grasping arm section 530*a* and first support arm section 520*a* define angle 514 which, in the embodiment shown in FIG. 5, is about 90°. Grasping arm 530 further includes a terminal grasping arm section 530*c* connected to the first grasping arm section 530*a* and defining angle 534 which, in the embodiment shown in FIG. 5, is about 90°. Device 500 also includes an adapter configured to support a beverage container having substantially straight sides, a narrower top section than bottom section, or requires additional support. In this embodiment, adapter 550 includes a flange portion 550*a* that is configured to mate with, seat in, and/or rest on/over ring or portion thereof 510; side wall(s) 550*b* attached to flange portion 550*a*, and a base 550*c* attached to the side wall(s) 550*b*. In some embodiments, base 550*c* includes a concentric bottom with a variety of depths configured to stabilize beverage containers having a narrower diameter than the inner diameter of the flange portion 550*a*. In some embodiments adapter 550 is removably inserted into ring or portion thereof 510. In some embodiments, adapter 550 is attached to or adhered to ring or portion thereof 510. In some embodiments, adapter 550 is temporarily or permanently secured to ring or portion thereof 510. In operation, a beverage container is seated in cup holder portion 510 and a plate is secured using support arm 520 and grasping arm 530. For example, a lip of a plate is slid into the aperture between support arm 520 and grasping arm 530. Terminal grasping arm section 530*c* prevents the plate from sliding by securing the lip of the plate (e.g., by forming a barrier to prevent the plate from sliding along the length of the support arm 520 and/or by applying pressure on the plate towards support arm 520. In some embodiments, grasping arm 530*c* is flexible, for example to allow temporary expansion of an aperture between the grasping arm 530 and the support arm 520. In some embodiments, at least a portion of grasping arm 530 is flexible. In some embodiments, first grasping arm section 530*a* is flexible. In some embodiments, terminal grasping arm section 530*c* is flexible. Flexibility properties of the grasping arm 530 or any portion thereof can be accomplished by any suitable means including, for example, forming the grasping arm 530 or any portion thereof of a material comprising a flexible component such as rubber, plastic, etc. In some embodiments, at least a portion of support arm 520 includes a surface texture to increase a coefficient of friction between the support arm 520 and the plate.

In some embodiments, the support arm (e.g., 120, 220, 320, 420, 520) defines or comprises a single continuous curve shape. In some embodiments, the support arm comprises, consists of, or consists essentially of a plurality of discrete sections. In some embodiments, such as those shown in FIGS. 1-5, the support arm includes two discrete sections. A first support arm section (120*a*, 220*a*, 320*a*, 420*a*, 520*a*) is attached to the ring or portion thereof (110, 210, 310, 410, 510). A second support arm section (120*b*, 220*b*, 320*b*, 420*b*, 520*b*) is attached to the first support arm section. In some embodiments, the support arm or a portion thereof (e.g., second support arm section 120*b*, 220*b*, 320*b*, 420*b*, 520*b*) includes a textured surface. In some embodiments, the textured surface is integrally formed into the support arm or portion thereof. In some embodiments, the textured surface is applied after formation of the support arm or portion thereof.

In some embodiments, the grasping arm (e.g., 130, 230, 330, 430, 530) defines or comprises a single continuous curve shape. In some embodiments, the grasping arm comprises, consists of, or consists essentially of a plurality of discrete sections. In some embodiments, such as those shown in FIGS. 1-3, the grasping arm includes three discrete sections. In these embodiments, a first grasping arm section (130*a*, 230*a*, 330*a*) is attached to the ring or portion thereof (110, 210, 310, 410, 510), while a second grasping arm section (130*b*, 230*b*, 330*b*) is attached to the first grasping arm section and to a terminal grasping arm section (130*c*, 230*c*, 330*c*). In some embodiments, such as those shown in FIGS. 4-5, the grasping arm includes two discrete sections. In these embodiments, a first grasping arm section (e.g., 430*a*, 530*a*) is connected to the ring or portion thereof (410, 510) and to a terminal grasping arm section (e.g., 430*c*, 530*c*).

In some embodiments, at least one support arm section is parallel or substantially parallel to at least one grasping arm section. For example, in FIGS. 1-3, the second support arm section (120*b*, 220*b*, 320*b*) is parallel or substantially parallel to the second grasping arm section (130*b*, 230*b*, 330*b*). Similarly, FIGS. 4-5 show embodiments wherein the first grasping arm section (430*a*, 530*a*) is parallel or substantially parallel to the second support arm section (420*b*, 520*b*).

In some embodiments, a portion of the grasping arm extends toward the support arm. In embodiments wherein the grasping arm comprises or consists of discrete sections, at least one grasping arm section may extend toward the support arm. For example, FIGS. 1-5 illustrate embodiments wherein the terminal grasping arm section (130*c*, 230*c*, 330*c*, 430*c*, 530*c*) extends from the second grasping arm section (130*b*, 230*b*, 330*b*) or the first grasping arm section (430*a*, 530*a*) towards the support arm (120, 220, 320).

In some embodiments, the angle (e.g., 114, 214, 314, 414, 514) defined by the separation of the support arm (e.g., 120, 220, 320, 420, 520) and the grasping arm (e.g., 130, 230, 330, 430, 530) is about 1° to about 180°, for example about 1°, about 2°, about 3°, about 4°, about 5°, about 6°, about 7°, about 8°, about 9°, about 10°, about 11°, about 12°, about 13°, about 14°, about 15°, about 16°, about 17°, about 18°, about 19°, about 20°, about 21°, about 22°, about 23°, about 24°, about 25°, about 26°, about 27°, about 28°, about 29°, about 30°, about 31°, about 32°, about 33°, about 34°, about 35°, about 36°, about 37°, about 38°, about 39°, about 40°, about 41°, about 42°, about 43°, about 44°, about 45°, about 46°, about 47°, about 48°, about 49°, about 50°, about 51°, about 52°, about 53°, about 54°, about 55°, about 56°, about 57°, about 58°, about 59°, about 60°, about 61°, about 62°, about 63°, about 64°, about 65°, about 66°, about 67°, about 68°, about 69°, about 70°, about 71°, about 72°, about 73°, about 74°, about 75°, about 76°, about 77°, about 78°, about 79°, about 80°, about 81°, about 82°, about 83°, about 84°, about 85°, about 86°, about 87°, about 88°, about 89°, about 90°, about 91°, about 92°, about 93°, about 94°, about 95°, about 96°, about 97°, about 98°, about 99°, about 100°, about 101°, about 102°, about 103°, about 104°, about 105°, about 106°, about 107°, about 108°, about 109°, about 110°, about 111°, about 112°, about 113°, about 114°, about 115°, about 116°, about 117°, about 118°, about 119°, about 120°, about 121°, about 122°, about 123°, about 124°, about 125°, about 126°, about 127°, about 128°, about 129°, about 130°, about 131°, about 132°, about 133°, about 134°, about 135°, about 136°, about 137°, about 138°, about 139°, about 140°, about 141°, about 142°, about 143°, about 144°, about 145°, about 146°, about 147°, about 148°, about 149°, about 150°, about 151°, about 152°, about 153°, about 154°, about 155°, about 156°, about 157°, about 158°, about 159°, about 160°, about 161°, about 162°, about 163°, about 164°, about 165°, about 166°, about 167°, about 168°, about 169°, about 170°, about 171°, about 172°, about 173°, about 174°, about 175°, about 176°, about 177°, about 178°, about 179°, or about 180°. In some embodiments, the angle is acute. In other embodiments, the angle is obtuse. In other embodiments, the angle is right.

In some embodiments, the angle (e.g., 124, 224, 324, 424, 524) defined by the first support arm section (e.g., 120*a*, 220*a*, 320*a*, 420*a*, 520*a*) and the second support arm section (120*b*, 220*b*, 320*b*, 420*b*, 520*b*) is about 1° to about 180°, for example about 1° about 2°, about 3°, about 4°, about 5°, about 6°, about 7°, about 8°, about 9°, about 10° about 11°, about 12°, about 13°, about 14°, about 15° about 16°, about 17°, about 18° about 19°, about 20°, about 21°, about 22°, about 23° about 24°, about 25°, about 26° about 27°, about 28°, about 29°, about 30°, about 31° about 32°, about 33°, about 34° about 35°, about 36°, about 37°, about 38°, about 39° about 40°, about 41°, about 42°, about 43°, about 44° about 45° about 46°, about 47° about 48°, about 49°, about 50° about 51°, about 52° about 53° about 54°, about 55° about 56°, about 57°, about 58° about 59°, about 60° about 61° about 62°, about 63° about 64°, about 65°, about 66° about 67°, about 68° about 69° about 70°, about 71° about 72°, about 73°, about 74° about 75°, about 76° about 77° about 78°, about 79° about 80°, about 81° about 82° about 83°, about 84° about 85° about 86°, about 87° about 88°, about 89° about 90° about 91°, about 92° about 93° about 94°, about 95° about 96°, about 97° about 98° about 99°, about 100°, about 101°, about 102°, about 103°, about 104°, about 105°, about 106°, about 107°, about 108°, about 109°, about 110°, about 111°, about 112°, about 113°, about 114°, about 115°, about 116°, about 117°, about 118°, about 119°, about 120° about 121°, about 122°, about 123°, about 124°, about 125°, about 126°, about 127° about 128°, about 129°, about 130°, about 131°, about 132°, about 133°, about 134° about 135°, about 136°, about 137°, about 138°, about 139°, about 140°, about 141° about 142°, about 143°, about 144°, about 145°, about 146°, about 147°, about 148° about 149°, about 150°, about 151°, about 152°, about 153°, about 154°, about 155° about 156°, about 157°, about 158°, about 159°, about 160°, about 161°, about 162° about 163°, about 164°, about 165°, about 166°, about 167°, about 168°, about 169° about 170°, about 171°, about 172°, about 173°, about 174°, about 175°, about 176°, about 177°, about 178°, about 179°, or about 180°. In some embodiments, the angle is acute. In other embodiments, the angle is obtuse. In other embodiments, the angle is right.

In some embodiments, the angle (e.g., 134, 234, 334, 434, 534) defined by the terminal grasping arm section (130*c*, 230*c*, 330*c*, 430*c*, 530*c*) and its adjacent grasping arm section (e.g., second grasping arm section 130*b*/230*b*/330*b* or first grasping arm section 430*a*, 530*a*) is about 1° to about 180°, for example about 1°, about 2°, about 3°, about 4°, about 5°, about 6°, about 7°, about 8°, about 9°, about 10°, about 11°, about 12°, about 13°, about 14°, about 15°, about 16°, about 17° about 18°, about 19°, about 20°, about 21°, about 22°, about 23°, about 24°, about 25° about 26°, about 27°, about 28°, about 29°, about 30°, about 31°, about 32°, about 33° about 34°, about 35°, about 36°, about 37° about 38° about 39°, about 40°, about 41° about 42°, about 43°, about 44° about 45° about 46° about 47°, about 48°, about 49° about 50°, about 51°, about 52° about 53° about 54° about 55°, about 56°, about 57° about 58°, about 59°, about 60° about 61° about 62° about 63°, about 64°, about 65° about 66°, about 67°, about 68° about 69° about 70° about 71°, about 72°, about 73° about 74°, about 75°, about 76° about 77° about 78° about 79°, about 80°, about 81° about 82°, about 83°, about 84° about 85° about 86° about 87°, about 88°, about 89°, about 90°, about 91°, about 92° about 93° about 94° about 95°, about 96°, about 97°, about 98°, about 99°, about 100° about 101°, about 102°, about 103°, about 104°, about 105°, about 106°, about 107° about 108°, about 109°, about 110°, about 111°, about 112°, about 113°, about 114° about 115°, about 116°, about 117°, about 118°, about 119°, about 120°, about 121° about 122°, about 123°, about 124°, about 125°, about 126°, about 127°, about 128° about 129°, about 130°, about 131°, about 132°, about 133°, about 134°, about 135° about 136°, about 137°, about 138°, about 139°, about 140°, about 141°, about 142° about 143°, about 144°, about 145°, about 146°, about 147°, about 148°, about 149° about 150°, about 151°, about 152°, about 153°, about 154°, about 155°, about 156° about 157°, about 158°, about 159°, about 160°, about 161°, about 162°, about 163° about 164°, about 165°, about 166°, about 167°, about 168°, about 169°, about 170°, about 171°, about 172°, about 173°, about 174°, about 175°, about 176°, about 177°, about 178°, about 179°, or about 180°. In some embodiments, the angle is acute. In other embodiments, the angle is obtuse. In other embodiments, the angle is right.

In some embodiments, the present disclosure provides an adapter for securing a beverage container (e.g., a cup, can, glass, etc.). In some embodiments, the beverage container includes straight or untapered side(s) (e.g., a can), or is narrower at the top than at the bottom. For beverage containers of these shapes, an adapter may be used in coordination with the device. In some embodiments, the adapter is inserted into the cup holder portion (e.g., the ring or portion thereof). In some embodiments, the adapter comprises, consists of, or consists essentially of a flange connected to one or more sides and a base. In some embodiments, the flange comprises a major diameter that is at least as large as the inner diameter of the cup holder (e.g., the ring or portion thereof), and a minor diameter that is smaller than the inner diameter of the cup holder (e.g., the ring or portion thereof). In some embodiments, the one or more sides comprise, consist of, or consist essentially of a collapsible or expandable material, such as a mesh or a net. In some embodiments, the one or more sides are formed of a rigid or semi-rigid material.

In some embodiments, the one or more sides are collapsible sufficient to allow the base and the support arm to simultaneously rest on a surface (e.g., a tabletop) without substantial tipping of the plate or the beverage container. For example, in the embodiment shown in FIG. 5, adapter 550 includes a flange 550*a* connected to a cylindrical side wall portion 550*b*, which in turn is connected to base 550*c*. The cylindrical side wall portion 550*b* is formed of a collapsible net material which, when device 500 is held by a user (not shown), the cylindrical side wall portion 550*b* has an expanded height $H_1$. When device 500 is placed on a surface, such as a tabletop, cylindrical side wall portion 550*b* collapses vertically until base 550*c* is in-line with the second support arm section 520*b*. In this resting configuration, cylindrical side wall portion 550*b* has a collapsed height $H_2$ that is less than expanded height $H_1$.

In any embodiment disclosed herein, the device may include a marketing feature. In some embodiments, the marketing feature is located on the cup holder portion (e.g., on the ring or portion thereof), for example on or incorporated into the outer surface and/or the top edge of the ring or portion thereof, the grasping arm or a portion thereof, the support arm or a portion thereof, a top edge of the flange of an adapter, and/or a side wall of an adapter. In some embodiments, the marketing feature comprises information that directs a user to a web site, such as a URL or a QR Code. In some embodiments, the marketing feature comprises a logo, such as a corporate logo or a team logo. In some embodiments, the marketing feature is personalized or includes an area for personalization. In some embodiments, the marketing feature includes a theme such as a birthday theme, a wedding theme, an anniversary theme, a graduation theme, a baby shower theme, a retirement theme, a sporting theme, and/or a holiday theme.

In one embodiment, the present disclosure provides a device comprising a ring or a portion thereof; a support arm connected to the ring or portion thereof at a first circumferential point; and a grasping arm connected to the ring or portion thereof in close proximity to the first circumferential point. In some embodiments, the ring or a portion thereof has an inner diameter sufficient to support a cup. In some embodiments, the support arm has a length sufficient to support a plate. In some embodiments, the grasping arm and the support arm are separated by a aperture sufficient to allow an edge of a plate to pass therethrough. In some embodiments, the grasping arm and the support arm are connected to the ring or portion thereof at the same circumferential point. In some embodiments, an angle formed by the grasping arm and the support arm at a point of connection with the ring or portion thereof is about 15° to about 115°, about 25° to about 105°, about 35° to about 95°, about 45° to about 85°, about 55° to about 75°, about 60° to about 70°, or about 90°. In some embodiments, the angle is acute. In other embodiments, the angle is obtuse. In other embodiments, the angle is right. In some embodiments, the ring or portion thereof comprises an angled inner surface, and wherein a circumference at a top edge of the ring or portion thereof is greater than a circumference at a bottom edge of the ring or portion thereof. In some embodiments, the device further comprises an adapter inserted in the ring or the portion thereof, wherein the adapter includes a base. In some embodiments, the adapter includes an upper rim that rests on a top edge of the ring or portion thereof. In some embodiments, the adapter has a cylindrical shape. In some embodiments, the adapter has a size sufficient to support a beverage can. In some embodiments, the adapter is collapsible along a vertical axis with respect to the support arm. In some embodiments, the adapter includes a rigid side wall. In some embodiments, the ring or portion thereof has a cross-sectional shape selected from the group consisting of: circle, oval, regular polygon, irregular polygon, rounded polygon, triangle, right triangle, equilateral triangle, quadrilateral, parallelogram, rectangle, square, trapezoid, kite, regular pentagon, irregular pentagon, regular hexagon, irregular hexagon, truncated circle, and squircle.

Figure 6A:
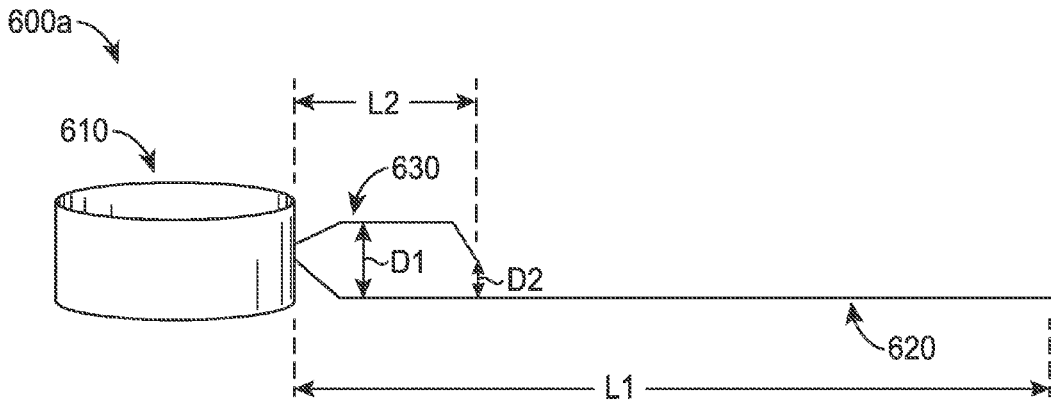
FIGS. 6A-6C depict use of a cross sectional view of an embodiment of the present disclosure with a dinner plate.
Figure 6B:
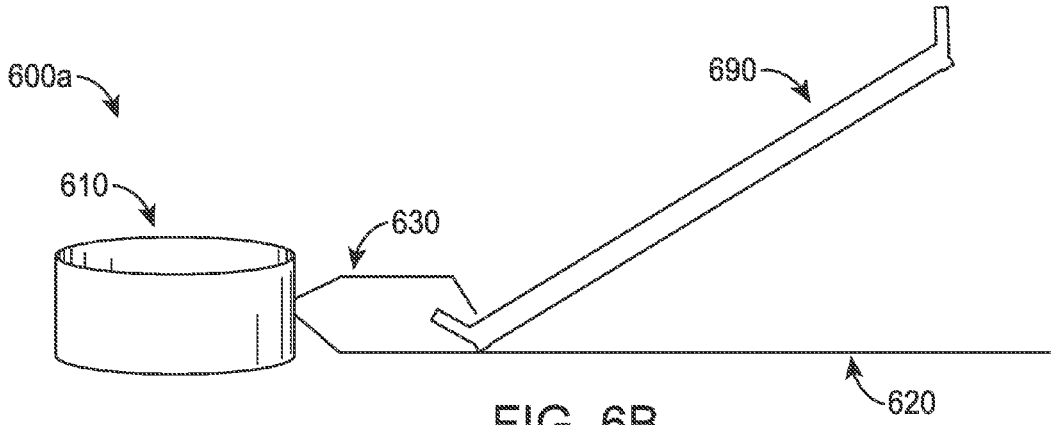
Figure 6C:
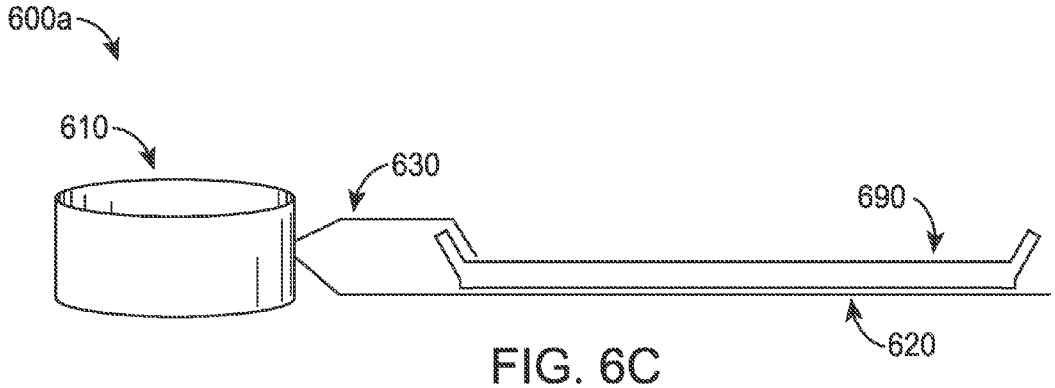

In another embodiment, such as that shown in FIG. 6A, the present disclosure provides a device 600*a* comprising a cup holder 610, a support arm 620 extending from the cup holder 610 including a substantially flat portion defining a first length L1; and a grasping arm 630 is configured to secure a first edge of a plate 690, and extends from the cup holder substantially parallel to the support arm 620 and defining a second length L2, wherein first length L1 is greater than second length L2. In some embodiments, the support arm 620 and the grasping arm 630 are separated by a first distance D1 and by a second, different distance D2, wherein the first distance D1 is greater than the second distance D2. As shown in FIGS. 6B-6C, in some embodiments the first distance D1 is sufficient to allow an edge of a plate 690 (e.g., an angled, beveled or raised edge) to pass therethrough. In some embodiments, the second distance D2 is sufficient to allow a base of a plate 690 to pass therethrough and insufficient to allow an edge of the plate 690 to pass therethrough after the plate 690 is secured in the device 600*a*. In such embodiments, the plate 690 can be secured by first passing the edge of the plate 690 through the smaller aperture (e.g., a aperture between the supporting arm 620 and the grasping arm 630 defining second distance D2) such as by orienting the plate 690 and the device 600 relative to each other such that the support arm 620 and the base of the plate 690 are not parallel (FIG. 6B). After passing the edge of the plate 690 through the smaller aperture D2, the device 600*a* and the plate 690 can be reoriented such that the base is parallel to and in contact with the support arm 620 (FIG. 6C). In some embodiments, the plate 690 (e.g., a plate supporting food or other items) is secured by holding the plate horizontally and tilting the device 600*a* relative to the plate 690 such that the support arm 630 is not horizontal. In some embodiments, the plate 690 (e.g., an empty plate) is secured by holding the device 600*a* such that the support arm 620 is substantially horizontal and tilting the plate 690 relative to the device 600*a* such that the base of the plate is not horizontal. In some embodiments, plate 690 is a dinner plate, a disposable plate, a paper plate, or a plastic plate. In some embodiments, the cup holder 610 comprises a ring or a portion thereof. In some embodiments, the device 600*a* further comprises an adapter inserted into the cup holder (not shown). In some embodiments, the adapter includes an upper rim that rests on a top edge of the ring or portion thereof. In some embodiments, the adapter has a cylindrical shape. In some embodiments, the adapter has a size sufficient to support a beverage container, such as a can. In some embodiments, the adapter is collapsible along a vertical axis with respect to the support arm. In some embodiments, the adapter includes a rigid side wall. In some embodiments, the ring or portion thereof has a cross-sectional shape selected from the group consisting of: circle, oval, regular polygon, irregular polygon, rounded polygon, triangle, right triangle, equilateral triangle, quadrilateral, parallelogram, rectangle, square, trapezoid, kite, regular pentagon, irregular pentagon, regular hexagon, irregular hexagon, truncated circle, and squircle. In some embodiments, grasping arm 630 is flexible, for example to allow temporary expansion of an aperture between the grasping arm 630 and the support arm 620 (e.g., increasing the first distance D1 and/or second distance D2. In some embodiments, at least a portion of grasping arm 630 is flexible. Flexibility properties of the grasping arm 630 or any portion thereof can be accomplished by any suitable means including, for example, forming the grasping arm 630 or any portion thereof of a material comprising a flexible component such as rubber, plastic, etc.

Figure 6D:
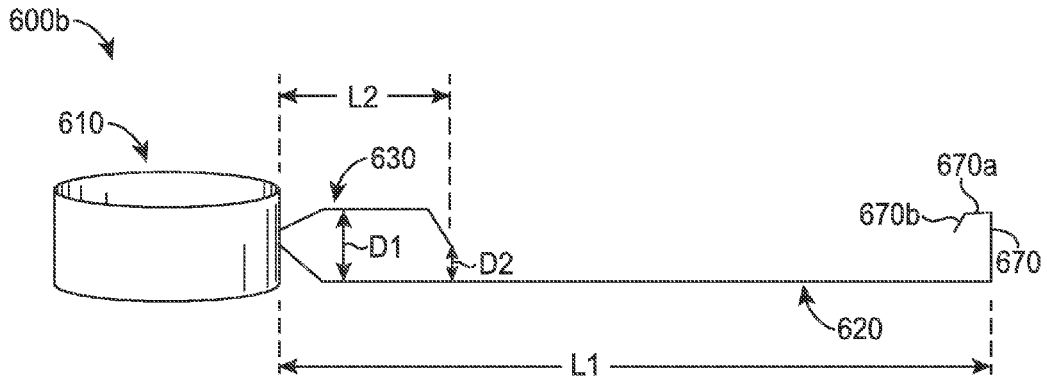
FIGS. 6D-6F depict use of a cross sectional view of another embodiment of the present disclosure with a dinner plate.
Figure 6E:
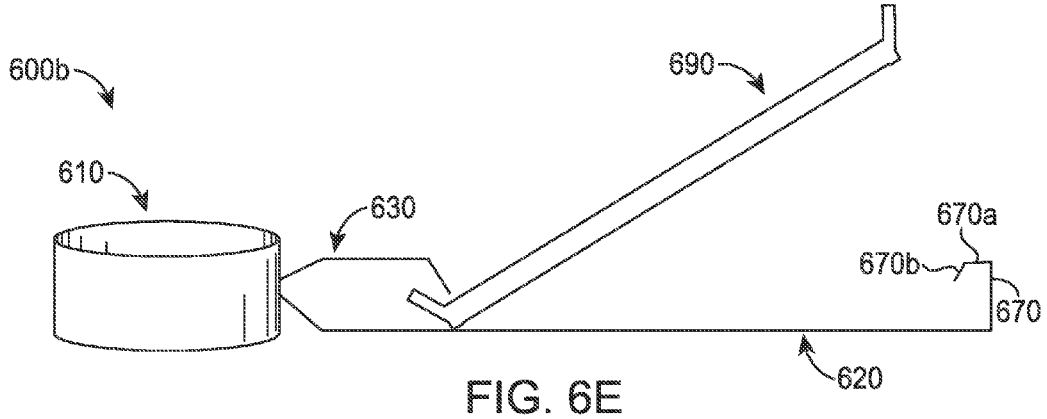
Figure 6F:
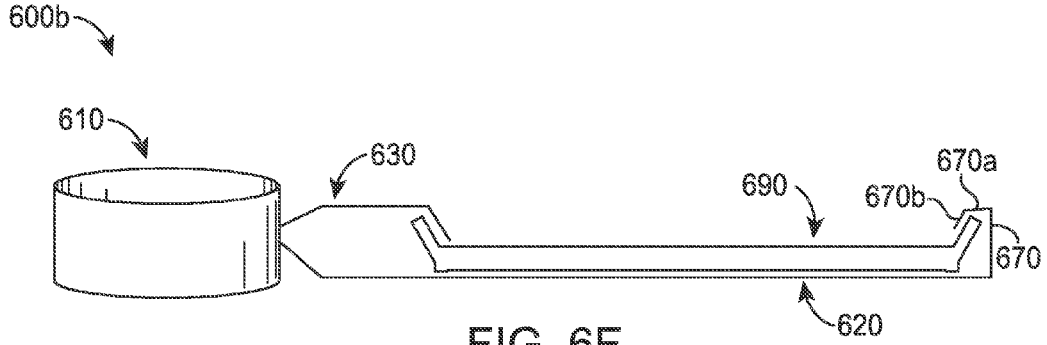

As shown in FIGS. 6D-6F, another embodiment of the present disclosure provides a device 600*b* that includes a cup holder 610, a support arm 620 extending from the cup holder 610 including a substantially flat portion defining a first length L1; and a grasping arm 630 is configured to secure a first edge of a plate 690, and extends from the cup holder substantially parallel to the support arm 620 and defining a second length L2, wherein first length L1 is greater than second length L2. In some embodiments, the support arm 620 and the grasping arm 630 are separated by a first distance D1 and by a second, different distance D2, wherein the first distance D1 is greater than the second distance D2, each substantially similar to or identical to the corresponding features of device 600 as shown and described with respect to FIGS. 6A-6C. Device 600*b* additionally includes a tab 670 configured to secure a second edge of the plate 690. The tab 670 may include first tab section 670*a* and a second tab section 670*b*. In some embodiments, at least a portion of tab 670 is flexible. In some embodiments, first tab section 670*a* is flexible. In some embodiments, second tab section 670*b* is flexible. Flexibility properties of the tab 670 or any portion thereof can be accomplished by any suitable means including, for example, forming the tab 670 or any portion thereof of a material comprising a flexible component such as rubber, plastic, etc. In some embodiments, at least a portion of tab 670 includes a surface texture to increase a coefficient of friction between the tab 670 and the plate 690. In operation, device 600*b* operates substantially the same as device 600*a*, for example by first passing one edge of the plate 690 through the smaller aperture (e.g., a aperture between the supporting arm 620 and the grasping arm 630 defining second distance D2) such as by orienting the plate 690 and the device 600*b* relative to each other such that the support arm 620 and the base of the plate 690 are not parallel (FIG. 6E). After passing the edge of the plate 690 through the smaller aperture D2, the device 600*b* and the plate 690 can be reoriented such that the base is parallel to and in contact with the support arm 620 (FIG. 6F). As the plate 690 is reoriented in this last step, the tab 670 engages with a second portion of the edge of the plate 690. The plate 690 is therefore secured at two substantially opposite points of its edge: a first portion by the grasping arm 630, and a second portion by the tab 670. In some embodiments, the first and second portions of the edge of the plate 690 are substantially opposite each other. In other embodiments, the first and second portions of the edge of the plate 690 are not opposite each other.

Figure 7:
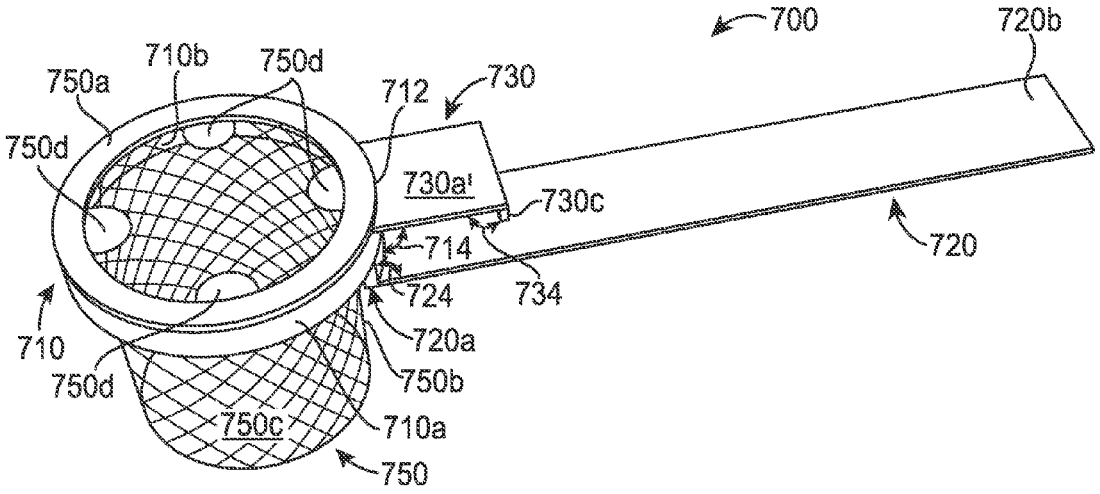
FIG. 7 shows a perspective view of an embodiment similar to that of FIG. 5 additionally including a plurality of flaps for securing a beverage container of relatively narrow outer diameter.

As shown in FIG. 7, one embodiment of the present disclosure includes a cup holder portion 710 that is a ring and includes an outer surface 710*a*, an inner surface 710*b*, a top edge 710*d* (not shown) and a bottom edge 710*e* (not shown). A support arm 720 and a grasping arm 730 are each attached to the cup holder portion 710 at circumferential point 712. Support arm 720 includes a first support arm section 720*a* that extends downwardly from the cup holder portion 710. In some embodiments, first support arm section 720*a* shares a continuous inner surface 720*a*' (not shown) with inner ring surface 710*b*. In some embodiments, first support arm section 720*a* shares a continuous outer surface 720*a*" (not shown) with outer ring surface 710*a*. A second support arm section 720*b* is connected to first support arm section 720*a* at an angle 724 which in the embodiment shown in FIG. 7 is about 90°. Grasping arm 730 includes a first grasping arm section 730*a* that includes a top surface 730*a*'. In some embodiments, top surface 730*a*' is continuous or substantially continuous with top ring edge 710*d*. First grasping arm section 730*a* and first support arm section 720*a* define angle 714 which, in the embodiment shown in FIG. 7, is about 90°. Grasping arm 730 further includes a terminal grasping arm section 730*c* connected to the first grasping arm section 730*a* and defining angle 734 which, in the embodiment shown in FIG. 7, is about 90°. Device 700 also includes an adapter configured to support a beverage container having substantially straight sides, a narrower top section than bottom section, or requires additional support. In this embodiment, adapter 750 includes a flange portion 750*a* that is configured to mate with, seat in, and/or rest on/over ring or portion thereof 710; side wall(s) 750*b* attached to flange portion 750*a*, and a base 750*c* attached to the side wall(s) 750*b*. In some embodiments, base 750*c* includes a concentric bottom with a variety of depths configured to stabilize beverage containers having a narrower diameter than the inner diameter of the flange portion 750*a*. In some embodiments, device 700 further includes one or more flaps 750*d* extending into the aperture formed by the cup holder portion 710. In one embodiment, the one or more flaps 750*d* are attached to the cup holder portion 710. In another embodiment, the one or more flaps 750*d* are attached to the adapter 750, for example to the flange portion 750*a*. In operation, the one or more flaps 750*d* apply a centering and/or stabilizing force (e.g., friction) to the outer side wall(s) of a beverage container placed into the cup holder portion 710, reducing lateral and/or vertical movement of the beverage container with respect to the device 700. The one or more flaps 750*d* can be formed of any suitable material, preferably one with flexible and/or texturized properties which allows the beverage container to easily be inserted into the cup holder portion 710 and requires additional force to remove the beverage container from the cup holder portion 710. Thus, in some embodiments, the one or more flaps 750*d* are formed of a material comprising a flexible component such as rubber, plastic, etc. Any suitable number of flaps 750*d* can be employed including, for example, 1 flap (e.g., a continuous ring or portion thereof), 2 flaps, 3 flaps, 4 flaps, 5 flaps, 6 flaps, 7 flaps, 8 flaps, 9 flaps, 10 flaps, or more than 10 flaps. For example and without limitation, in the embodiment shown in FIG. 7, device 700 includes four flaps 750*d* extending into the aperture formed by the cup holder portion 710 and/or the flange portion 750*a*. In some embodiments adapter 750 is removably inserted into ring or portion thereof 710. In some embodiments, adapter 750 is attached to or adhered to ring or portion thereof 710. In some embodiments, adapter 750 is temporarily or permanently secured to ring or portion thereof 710. In operation, a beverage container is seated in cup holder portion 710 and a plate is secured using support arm 720 and grasping arm 730. For example, a lip of a plate is slid into the aperture between support arm 720 and grasping arm 730. Terminal grasping arm section 730*c* prevents the plate from sliding by securing the lip of the plate (e.g., by forming a barrier to prevent the plate from sliding along the length of the support arm 720 and/or by applying pressure on the plate towards support arm 720. In some embodiments, grasping arm 730*c* is flexible, for example to allow temporary expansion of an aperture between the grasping arm 730 and the support arm 720. In some embodiments, at least a portion of grasping arm 730 is flexible. In some embodiments, first grasping arm section 730*a* is flexible. In some embodiments, terminal grasping arm section 730*c* is flexible. Flexibility properties of the grasping arm 730 or any portion thereof can be accomplished by any suitable means including, for example, forming the grasping arm 730 or any portion thereof of a material comprising a flexible component such as rubber, plastic, etc. In some embodiments, at least a portion of support arm 720 includes a surface texture to increase a coefficient of friction between the support arm 720 and the plate.

Figure 8A:
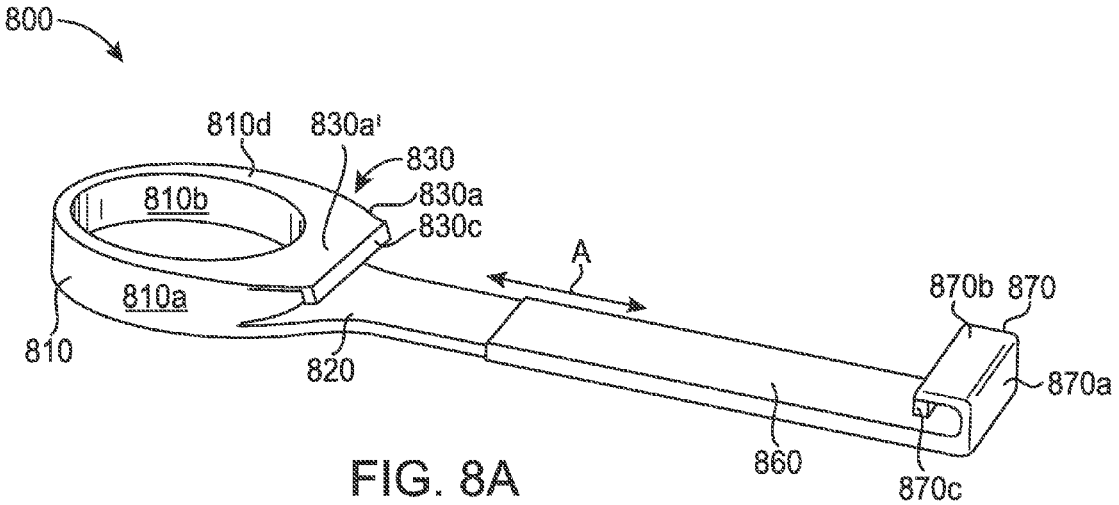
FIGS. 8A-8B show a perspective view of another embodiment of the present disclosure having an adjustable length.
Figure 8B:
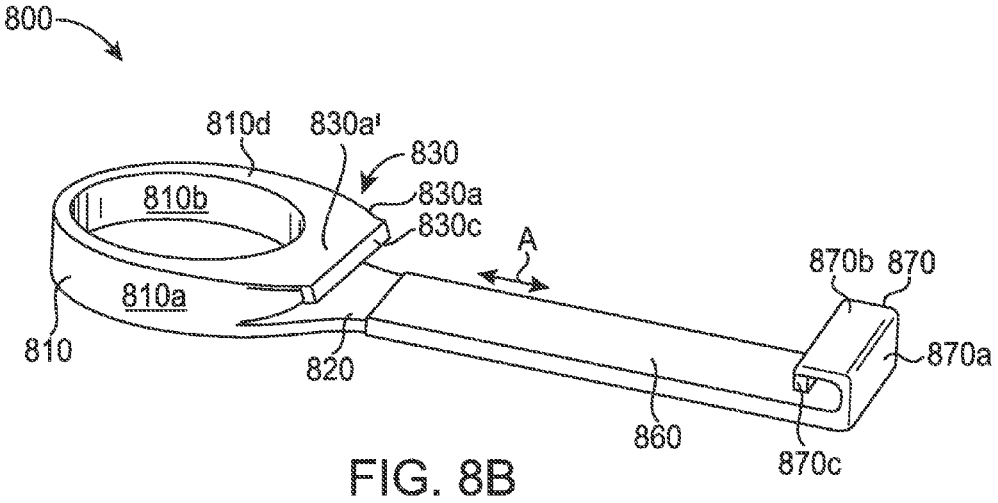

Turning now to FIGS. 8A-8B, another embodiment of the present disclosure provides a device 800 including a cup holder portion 810, a support arm 820, a first grasping arm 830, and an adjustable arm portion 860. The cup holder portion 810 may be substantially similar to or essentially the same as other cup holder portions (110, 210, 310, 410, 510, 610710) as described herein, and therefore may include an outer surface 810*a*, an inner surface 810*b*, a top edge 810*d* and a bottom edge 810*e* (not shown). The first grasping arm 830 may be configured consistent with first grasping arms disclosed herein, and therefore may include a first grasping arm section 830*a* that includes a top surface 830*a*'. As shown in FIG. 8A-8B, the top surface 830*a*' in this embodiment is continuous or substantially continuous with top ring edge 810*d*. The first grasping arm 830 further includes a terminal grasping arm section 830*c* connected to the first grasping arm section 830*a*. The adjustable arm portion 860 includes a tab 870 which may include a first tab portion 870*a* extending in a generally orthogonal direction from the support arm 820. The tab 870 also includes a second tab portion 870 which generally extends from the first tab portion 870*a* towards the cup holder portion 810. The tab 870 also includes a terminal tab portion 870*c* which extends toward the support arm portion 820. The adjustable arm portion 860 is configured to slide along or extend from the support arm 820 along an axis A. Accordingly, device 800 can be configured in a first, extended configuration as shown in FIG. 8A, for example to allow a user to place a plate on the support arm portion 820/adjustable arm portion 860 without tipping the plate relative to the device 800 or vice versa. After the plate is positioned between the first grasping arm 830 and the tab 870, the user can slide the adjustable arm portion 860 along axis A to form a second, compressed configuration as shown in FIG. 8B in order to secure a plate. In some embodiments, the plate is secured by sliding the adjustable arm portion 860 along axis A such that a first portion of the plate is secured by the terminal grasping arm portion 830*c*, and a second portion of the plate is secured by the terminal tab portion 870*c*.

Figure 9:
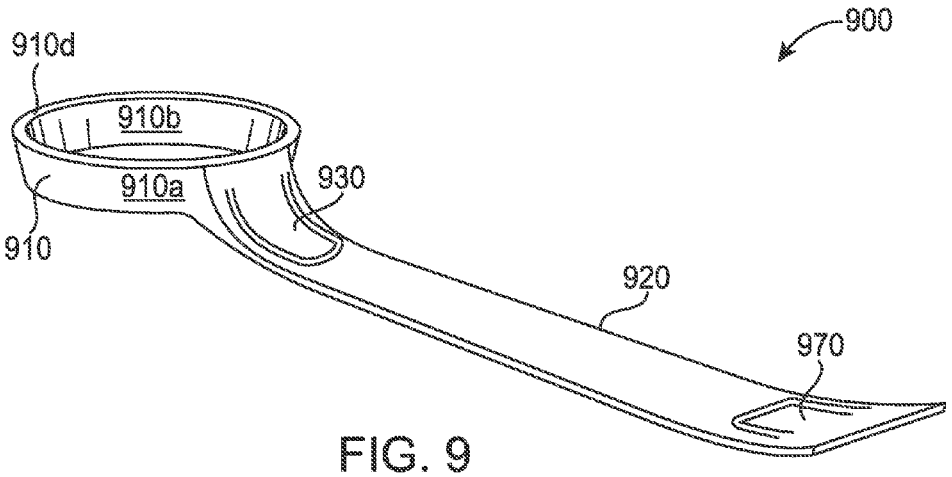
FIG. 9 shows a perspective view of another embodiment of the present disclosure including two tabs for securing a plate.

Referring now to FIG. 9, another embodiment of the present disclosure provides a device 900 including a cup holder portion 910, a support arm 920, a first tab 930 and a second tab 970. The cup holder portion 910 may be substantially similar to or essentially the same as other cup holder portions (110, 210, 310, 410, 510, 610, 710, 810) as described herein, and therefore may include an outer surface 910*a*, an inner surface 910*b*, a top edge 910*d* and a bottom edge 910*e* (not shown). The support arm 920 extends outwardly from the cup holder portion 910 and is configured to support a thin plate, such as a paper plate. As shown in FIG. 9, the support arm 920 may be generally flat, but may include a curved portion at the proximal and/or the distal ends. The curved portions may be sized and shaped to mimic (e.g., approximate or match) a profile or shape of a plate, such as a disposable plastic or paper plate. The first tab 930 is integrally formed in the support arm 920 and/or the cup holder portion 910, and is configured to retain a portion of an edge of the plate. The second tab 970 is integrally formed in the support arm 920 and/or the cup holder portion 910, and is configured to retain a portion of an edge of the plate. In operation, a plate is secured by the device 900 by sliding an edge of the plate under one of the first or second tabs 930, 970. The plate may then be secured by sliding a second, substantially opposite edge of the plate under the other of the first or second tabs 930, 970.

Figure 10:
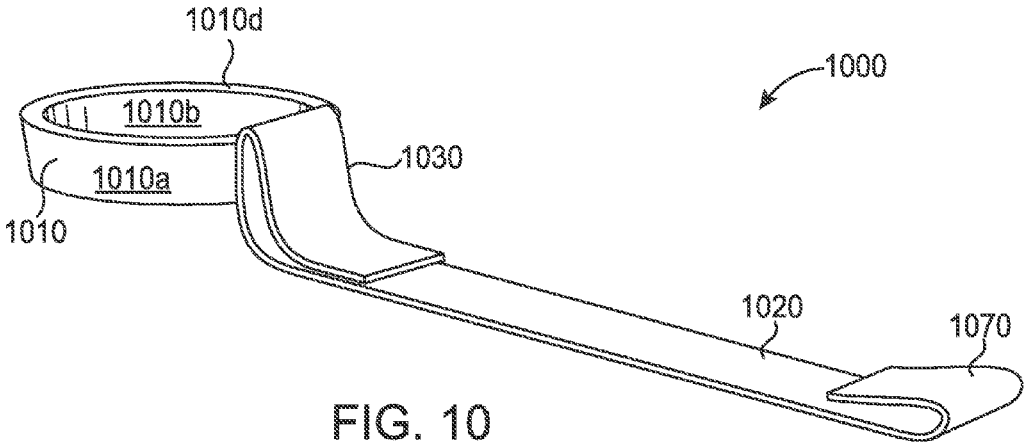
FIG. 10 shows a perspective view of another embodiment of the present disclosure including two tabs for securing a plate.

Referring now to FIG. 10, another embodiment of the present disclosure provides a device 1000 including a cup holder portion 1010, a support arm 1020, a first tab 1030 and a second tab 1070. The cup holder portion 1010 may be substantially similar to or essentially the same as other cup holder portions (110, 210, 310, 410, 510, 610, 710, 810, 910) as described herein, and therefore may include an outer surface 1010*a*, an inner surface 1010*b*, a top edge 1010*d* and a bottom edge 1010*e* (not shown). The support arm 1020 extends outwardly from the cup holder portion 1010 and is configured to support a thin plate, such as a paper plate. As shown in FIG. 10, the support arm 1020 may be generally flat, but may include a curved portion at the proximal and/or the distal ends. The curved portions may be sized and shaped to mimic (e.g., approximate or match) a profile or shape of a plate, such as a disposable plastic or paper plate. The first tab 1030 is integrally formed in the support arm 1020 and/or the cup holder portion 1010, and is configured to retain a portion of an edge of the plate. The second tab 1070 is integrally formed in the support arm 1020 and/or the cup holder portion 1010, and is configured to retain a portion of an edge of the plate. In operation, a plate is secured by the device 1000 by sliding an edge of the plate under one of the first or second tabs 1030, 1070. The plate may then be secured by sliding a second, substantially opposite edge of the plate under the other of the first or second tabs 1030, 1070.

Figure 11:
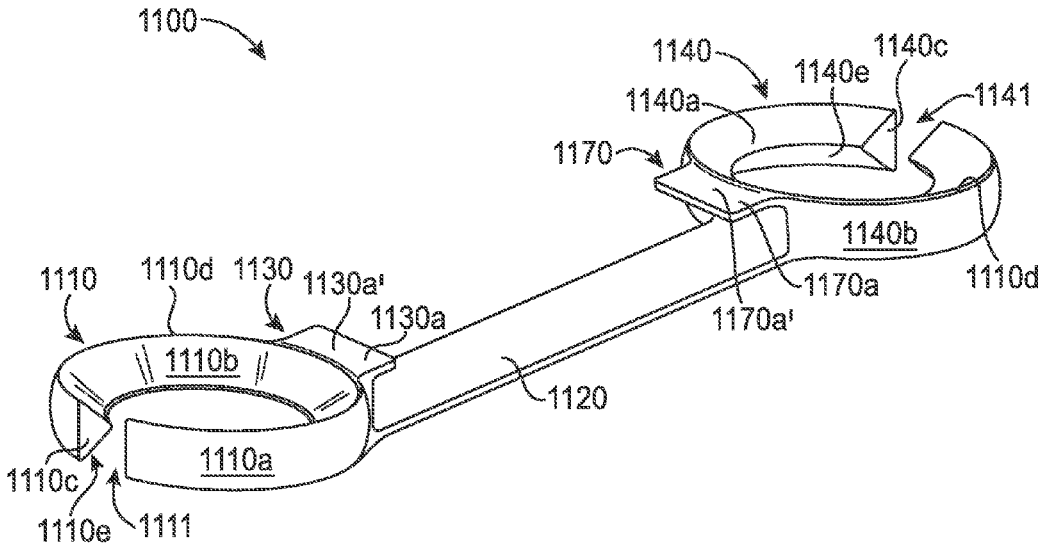
FIG. 11 shows a perspective view of another embodiment of the present disclosure including two beverage container holders.

The present disclosure also provides a device for holding a plate and more than one beverage containers. For example, as shown in FIG. 11, a device 1100 includes a first cup holder 1110 attached to a second cup holder 1140 by a support arm 1120. Each of the first and second cup holders 1110, 1140 can be configured consistent with any cup holder portion described herein (e.g., cup holder portion 110, 210, 310, 410, 510, 610, 710, 810, 910, and/or 1010). In the embodiment shown in FIG. 11, each of cup holders 1110, 1140 is configured substantially the same. However, in other embodiments, the first cup holder 1110 may have a first configuration while the second cup holder 1140 may have a second, different configuration, for example for holding a different type of beverage container than the first cup holder 1110. In the embodiment shown in FIG. 11, the first cup holder 1110 includes an outer surface 1110*a* and an inner surface 1110*b* that are not parallel, and are configured to provide a top edge 1110*d* that is narrower than a bottom edge 1110*e*. Cup holder portion 1110 thus has a cross-sectional shape 1110*c* that is generally triangular. In some embodiments, the cross-sectional shape 1110*c* is another shape, such as a regular or irregular polygon, an oval, a circle, or the like. The second cup holder 1140 includes an outer surface 1140*a* and an inner surface 1140*b* that are not parallel, and are configured to provide a top edge 1140*d* that is narrower than a bottom edge 1140*e*. Cup holder portion 1140 thus has a cross-sectional shape 1140*c* that is generally triangular. In some embodiments, the cross-sectional shape 1140*c* is another shape, such as a regular or irregular polygon, an oval, a circle, or the like. In the embodiment shown in FIG. 11, each of the first cup holder 1110 and the second cup holder 1140 are each discontinuous rings including an aperture 1111, 1141. The first grasping arm 1130 and second grasping arm 1170 may independently be configured according to any other embodiment disclosed herein. In the embodiment shown in FIG. 11, the first grasping arm 1130 and the second grasping arm 1170 are similarly configured. First grasping arm 1130 is connected to the first cup holder portion 1110, and includes a first grasping arm section 1130*a* that includes a top surface 1130*a*'. Top surface 1130*a*' is substantially continuous with the top edge 1110*d* of the first cup holder portion 1110. Similarly, second grasping arm 1170 is connected to the second cup holder portion 1140, and includes a first grasping arm section 1170*a* that includes a top surface 1170*a*' which is substantially continuous with the top edge 1140*d* of the second cup holder portion 1140. Other shapes and configurations of the cup holder portions 1110, 1140 and tab portions 1130, 1170 are possible and within the scope of the present disclosure.

In another embodiment, the present disclosure provides a device for holding a beverage container and a plate, the device comprising a first aperture configured to secure a beverage container, wherein the first aperture is oriented in a first plane and is defined by a ring or a portion thereof; and a second aperture configured to secure a plate, wherein the second aperture is oriented in a second plane which is substantially orthogonal to the first plane, and is defined by a support arm and a grasping arm, the support arm and the grasping arm each connected to the ring or a portion thereof at a circumferential point. In some embodiments, the first aperture is defined by a ring. In some embodiments, the ring or a portion thereof has an inner diameter sufficient to support a cup. In some embodiments, the support arm has a length sufficient to support a plate. In some embodiments, the second aperture comprises a aperture sufficient to allow an edge of a plate to pass therethrough. In some embodiments, an angle formed by the grasping arm and the support arm at a point of connection with the ring or portion thereof is about 15° to about 115°, about 25° to about 105°, about 35° to about 95°, about 45° to about 85°, about 55° to about 75°, about 60° to about 70°, or about 90°. In some embodiments, the angle is acute. In other embodiments, the angle is obtuse. In other embodiments, the angle is right. In some embodiments, the ring or portion thereof comprises an angled inner surface, and wherein a circumference at a top edge of the ring or portion thereof is greater than a circumference at a bottom edge of the ring or portion thereof. In some embodiments, the device further comprises an adapter inserted in the ring or the portion thereof, wherein the adapter includes a base. In some embodiments, the adapter includes an upper rim that rests on a top edge of the ring or portion thereof. In some embodiments, the adapter has a cylindrical shape. In some embodiments, the adapter has a size sufficient to support a beverage can. In some embodiments, the adapter is collapsible along a vertical axis with respect to the support arm. In some embodiments, the adapter includes a rigid side wall. In some embodiments, the ring or portion thereof has a cross-sectional shape selected from the group consisting of: circle, oval, regular polygon, irregular polygon, rounded polygon, triangle, right triangle, equilateral triangle, quadrilateral, parallelogram, rectangle, square, trapezoid, kite, regular pentagon, irregular pentagon, regular hexagon, irregular hexagon, truncated circle, and squircle.

Any material suitable for providing desirable characteristics for the device can be utilized. In any embodiment described herein, at least a portion of the device may be formed of a recycled, a recyclable, and/or a renewable material. In some embodiments, at least one surface of the device, for example the support arm, includes a texture for increasing a coefficient of friction between the support arm and a plate in contact thereof.

In some embodiments, any device according to the present disclosure further comprises one or more inserts configured to secure a beverage container of irregular, or inconsistent size or shape, of a size and/or shape significantly smaller than securable by an illustrated embodiment, and/or of a shape other than generally cylindrical, and/or having a cross-sectional shape other than a circle.

In some embodiments, any device according to the present disclosure is configured to secure a plate formed from any material including, for example, paper, plastic, glass, ceramic, stoneware, etc.

In some embodiments, any device according to the present disclosure is formed of a material that is at least partially recycled, renewable, of low density, easily cleanable, and/or recyclable.

In some embodiments, any device according to the present disclosure improves structural support for a plate (e.g., a disposable or paper plate).

In some embodiments, any device according to the present disclosure can be balanced by a user with a single hand, for example by supporting the supporting arm of a device disclosed herein (optionally including a plate and a beverage container) with the palm and/or one or more fingers, and stabilizing the device by placing a thumb on top of the grasping arm.

From the foregoing, it will be appreciated that specific embodiments of the invention have been described herein for purposes of illustration, but that various modifications may be made without deviating from the scope of the invention. Accordingly, the invention is not limited except as by the appended claims.

We claim:

1. A cup holder comprising:

a support arm extending from the cup holder including a substantially flat portion defining a first length L1; and a grasping arm extending from the cup holder substantially parallel to the support arm and defining a second length L2, wherein: first length L1 is greater than second length L2; the support arm comprises a first support arm section attached to the cup holder and a second support arm section; the grasping arm comprises a first grasping arm section attached to the cup holder and a second grasping arm section; the first support arm section and the first grasping arm section are not parallel to one another; the second support arm section is substantially parallel to the second grasping arm section and to a plane formed by a circumferential opening in the cup holder; the support arm and the grasping arm are separated by a first distance D1 and by a second, different distance D2, wherein the first distance D1 is greater than the second distance D2; and the second distance D2 is sufficient to allow a base of a plate to pass therethrough and insufficient to allow an edge of the plate to pass therethrough when the base of the plate is parallel to and in connection with the support arm.

2. The cup holder of claim 1, wherein the first distance D1 is sufficient to allow an edge of a plate to pass therethrough.

3. The device of claim 1 further comprising a marketing feature.

4. The device of claim 3, wherein the marketing feature comprises a QR code, a team logo, a corporate logo, and/or an area for personalization.

* * * * *